US008078475B2

(12) United States Patent
Tsushima

(10) Patent No.: US 8,078,475 B2
(45) Date of Patent: Dec. 13, 2011

(54) AUDIO SIGNAL ENCODER AND AUDIO SIGNAL DECODER

(75) Inventor: Mineo Tsushima, Nara (JP)

(73) Assignee: Panasonic Corporation, Osaka (JP)

( * ) Notice: Subject to any disclaimer, the term of this patent is extended or adjusted under 35 U.S.C. 154(b) by 1380 days.

(21) Appl. No.: 11/579,740

(22) PCT Filed: May 17, 2005

(86) PCT No.: PCT/JP2005/008997

§ 371 (c)(1),
(2), (4) Date: Nov. 7, 2006

(87) PCT Pub. No.: WO2005/112002

PCT Pub. Date: Nov. 24, 2005

(65) Prior Publication Data

US 2007/0244706 A1 Oct. 18, 2007

(30) Foreign Application Priority Data

May 19, 2004 (JP) ..... 2004-148661

(51) Int. Cl.
*G10L 19/00* (2006.01)
*H04R 5/00* (2006.01)

(52) U.S. Cl. ..... 704/500; 704/219; 704/201; 381/23

(58) Field of Classification Search ..... 704/500, 704/201, 219

See application file for complete search history.

(56) References Cited

U.S. PATENT DOCUMENTS 5,649,054 A * 7/1997 Oomen et al. ..... 704/229
5,859,826 A 1/1999 Ueno et al.
6,061,649 A 5/2000 Oikawa et al.
6,356,211 B1 * 3/2002 Shimoyoshi et al. ..... 341/50
6,393,392 B1 5/2002 Minde
7,447,317 B2 * 11/2008 Herre et al. ..... 381/23

(Continued)

FOREIGN PATENT DOCUMENTS

EP 0 688 113 12/1995

(Continued)

OTHER PUBLICATIONS

Breebaart, Jeroen; van de Par, Steven; Kohlrausch, Armin; Schuijers, Erik. High-quality Parametric Spatial Audio Coding at Low Bitrates. AES Convention:116 (May 2004) Paper No. 6072.*

(Continued)

*Primary Examiner* — Talivaldis Ivars Smits
*Assistant Examiner* — Matthew Baker
(74) *Attorney, Agent, or Firm* — Wenderoth, Lind & Ponack, L.L.P.

(57) ABSTRACT

A portable player or a multi-channel home player includes: a mixed signal decoding unit that extracts, from a first inputted coded stream, a second coded stream representing a downmix signal into which multi-channel audio signals are mixed and supplementary information for reverting the downmix signal back to the multi-channel audio signals before being downmixed, and that decodes the second coded stream representing the downmix signal; a signal separation processing unit that separates the downmix signal obtained by decoding based on the extracted supplementary information and that generates audio signals which are acoustically approximate to the multi-channel audio signals before being downmixed; and headphones or speakers that reproduce the decoded downmix signal or speakers that reproduce the multi-channel audio signals separated from the downmix signal.

7 Claims, 11 Drawing Sheets

U.S. PATENT DOCUMENTS

| | | | | |
|---|---|---|---|---|
| 7,447,629 | B2 * | 11/2008 | Breebaart | 704/219 |
| 7,502,743 | B2 * | 3/2009 | Thumpudi et al. | 704/500 |
| 7,542,896 | B2 * | 6/2009 | Schuijers et al. | 704/201 |
| 7,945,447 | B2 * | 5/2011 | Yoshida et al. | 704/500 |
| 2004/0161116 | A1 | 8/2004 | Tsuji et al. | |
| 2005/0177360 | A1 * | 8/2005 | Schuijers et al. | 704/201 |

FOREIGN PATENT DOCUMENTS

| | | | |
|---|---|---|---|
| EP | 0 714 173 | | 5/1996 |
| EP | 0 878 798 | | 11/1998 |
| EP | 0 971 350 | | 1/2000 |
| EP | 1107232 | A2 * | 6/2001 |
| EP | 1 507 256 | | 2/2005 |
| JP | 8-065169 | | 3/1996 |
| JP | 9-102742 | | 4/1997 |
| JP | 11-032399 | | 2/1999 |
| JP | 2000-123481 | | 4/2000 |
| JP | 2000-148193 | | 5/2000 |
| JP | 2002-526798 | | 8/2002 |
| JP | 2003-195894 | | 7/2003 |
| JP | 2003-337598 | | 11/2003 |
| WO | 95/34956 | | 12/1995 |
| WO | 99/23657 | | 5/1999 |
| WO | 03/098602 | | 11/2003 |
| WO | 2004/008805 | | 1/2004 |
| WO | WO 2004/008806 | | 1/2004 |

OTHER PUBLICATIONS

Schuijers, Erik; Breebaart, Jeroen; Purnhagen, Heiko; Engdegard, Jonas. Low Complexity Parametric Stereo Coding. AES Convention:116 (May 2004) Paper No. 6073.*

Oomen, Werner; Schuijers, Erik; den Brinker, Bert; Breebaart, Jeroen. Advances in Parametric Coding for High-Quality Audio. Philips Digital Systems Laboratories, Eindhoven, The Netherlands. AES Convention:114 (Mar. 2003) Paper No. 5852.*

Herre, Jurgen; Schulz, Donald. Extending the MPEG-4AAC Codec by Perceptual Noise Substitution. Presented at the 104th AES Convention May 16-19, 1998.*

ISO/IEC 14496-3:1999(E). MPEG-4 standard, published May 15, 1998.*

ISO/IEC 14496-3:1999(E) Annex B. MPEG-4 standard, published May 15, 1998.*

Geiger, Ralf; Schuller, Gerald; Herre, Jürgen; Sperschneider, Ralph; Sporer, Thomas. Scalable Perceptual and Lossless Audio Coding Based on MPEG-4 AAC.*

Liebchen, Tilman. Lossless Audio Coding Using Adaptive Multichannel Prediction. Affiliation: Institute for Telecommunication Systems, Technical University of Berlin, Germany. AES Convention:113 (Oct. 2002) Paper No. 5680.*

Ramprashad, S.A.; , "Stereophonic CELP coding using cross channel prediction," Speech Coding, 2000. Proceedings. 2000 IEEE Workshop on , volume., number., pp. 136-138, 2000. doi: 10.1109/SCFT.2000.878428. URL: http://ieeexplore.ieee.org/stamp/stamp.jsp?tp=&arnumber=878428&isnumber=18924.*

Chinese Office Action issued Jan. 11, 2010 in a Chinese application that is a foreign counterpart to the present application.

European Search Report issued Sep. 3, 2007 in conjunction with EP application No. 05 741 297.5-2225 which is a counterpart to the present application.

M. Bosi et al., ISO/IEC 13818-7(MPEG2 Advanced Audio Coding, AAC), Apr. 1997.

Christof Faller and Frank Baumgarte, "Binaural Cue Coding—Part II: Schemes and Applications," IEEE Transaction on Speech and Audio Processing, vol. 11, No. 6, Nov. 2003, pp. 520-531.

* cited by examiner

AUDIO SIGNAL ENCODER AND AUDIO SIGNAL DECODER

TECHNICAL FIELD

The present invention relates to an encoder which encodes audio signals and a decoder which decodes the coded audio signals.

BACKGROUND ART

As a conventional audio signal decoding method and a coding method, there exists the ISO/IEC International Standard schemes; that is, the so-called MPEG schemes. Currently, as a coding scheme which has a wide variety of applications and provides a high quality even with a low bit rate, there exists the ISO/IEC 13818-7; that is, the so-called MPEG-2 Advanced Audio Coding (AAC) scheme. Expanded standards of the scheme are currently being standardized (refer to Reference 1).

Reference 1: ISO/IEC 13818-7 (MPEG-2 AAC)

SUMMARY OF INVENTION

Problems that Invention is to Solve

However, in the conventional audio signal coding method and decoding method, for example, the AAC described in the Background Art, a correlation between channels is not fully utilized in coding multi-channel signals. Thus, it is difficult to realize a low bit rate. FIG. 1 is a diagram showing a conventional audio signal coding method and decoding method in decoding coded multi-channel signals. As shown in FIG. 1, in the case of a conventional multi-channel AAC encoder 600 for example, it encodes 5.1-channel audio signals, multiplexes these signals, and sends the multiplexed signals to a conventional player 610 via broadcast or the like. The conventional player 610 which receives coded data like this has a multi-channel AAC decoding unit 611 and a downmix unit 612. In the case where outputs are 2-channel speakers or headphones, the conventional player 610 outputs the downmix signals generated from the received coded signals to the 2-channel speakers or the headphones 613.

However, the conventional player 610 decodes all channels first, in the case of decoding the signals obtained by coding the multi-channel signals of original audio signals and reproducing the decoded signals through the 2 speakers or the headphones. Subsequently, the downmix unit 612 generates downmix signals DR (right) and DL (left) to be reproduced through the 2 speakers or headphones from all decoded channels by using a method such as downmixing. For example, 5.1 multi-channel signals are composed of: 5-channel audio signals from an audio source placed at the front-center (Center), front-right (FR), front-left (FL), back-right (BR), and back-left (BL) of a listener; and 0.1-channel signal LFE which represents an extremely low region of the audio signals. The downmix unit 612 generates the downmix signals DR and DL by adding weighted multi-channel signals. This requires a large amount of calculation and a buffer for the calculation even in the case where these signals are reproduced through the 2 speakers or headphones. Consequently, this causes an increase in power consumption and cost of a calculating unit such as a Digital Signal Processor (DSP) that mounts the buffer.

Means to Solve the Problems

In order to solve the above-described problem, an audio signal decoder of the present invention decodes a first coded stream and outputs audio signals. The audio signal decoder includes: an extraction unit which extracts, from the inputted first coded stream, a second coded stream representing a mixed signal fewer than a plurality of audio signals mixed into the mixed signal and supplementary information for reverting the mixed signal to the pre-mixing audio signals; a decoding unit which decodes the second coded stream representing the mixed signal; a signal separating unit which separates the mixed signal obtained in the decoding based on the extracted supplementary information and generates the plurality of audio signals which are acoustically approximate to the pre-mixing audio signals; and a reproducing unit which reproduces the decoded mixed signal or the plurality of audio signals separated from the mixed signal.

Note that the present invention can be realized as an audio signal encoder and an audio signal decoder like this, but also as an audio signal encoding method and an audio signal decoding method, and as a program causing a computer to execute these steps of the methods. Further, the present invention can be realized as an audio signal encoder and an audio signal decoder having an embedded integrated circuit for executing these steps. Note that such program can be distributed through a recording medium such as a CD-ROM and a communication medium such as the Internet.

Effects of the Invention

As described above, an audio signal encoder of the present invention generates a coded stream from a mixture of multiple signal streams, and adds very small amount of supplementary information to the coded stream focusing on the similarity between the signals when separating the generated coded stream into multiple signal streams. This makes it possible to separate the signals so that they sound natural. In addition, on condition that a previously mixed signal is composed as a downmix signal of multi-channel signals, decoding the downmix signal parts alone without processing these signals by reading supplementary information in decoding makes it possible to reproduce these signals through the speakers or headphones having a system for reproducing such 2-channel signals with a high quality and by a low calculation amount.

NUMERICAL REFERENCES

Figure 1:
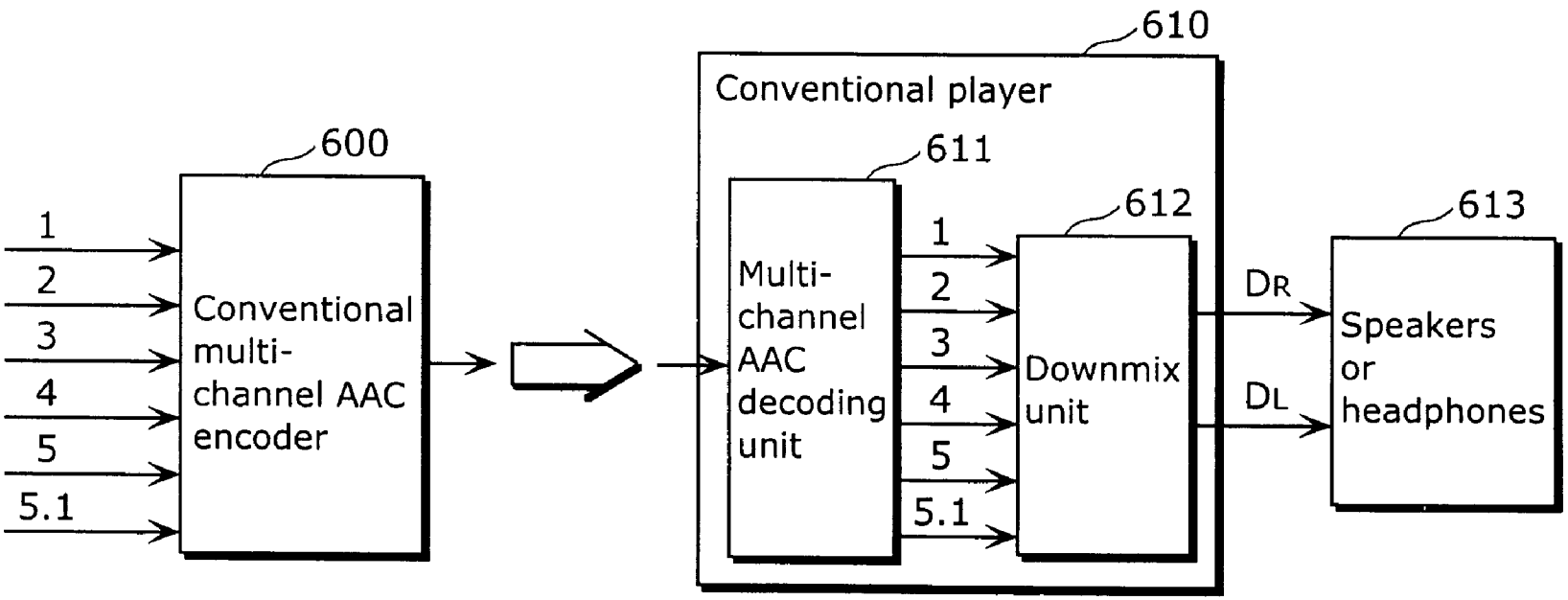
FIG. 1 is a diagram showing an example of an encoding method and a decoding method of conventional multi-channel signals.

101 Mixed signal information
102 Mixed signal decoding unit
103 Signal separation processing unit
104 Supplementary information
105 Output signal (1)
106 Output signal (2)
201 Input signal (1)
202 Input signal (2)
203 Mixed signal encoding unit
204 Supplementary information generating unit
205 Supplementary information
206 Mixed signal information
211 Gain calculating unit
212 Phase calculating unit
213 Coefficient calculating unit
301 Mixed signal information
302 Mixed signal decoding unit
303 Signal separating unit
304 Gain control unit
305 Output signal (1)
306 Output signal (2)
307 Supplementary information
308 Time-frequency matrix generating unit
401 Mixed signal information
402 Mixed signal decoding unit
403 Signal separating unit
404 Gain control unit
405 Output signal (1)
406 Output signal (2)
407 Supplementary information
408 Time-frequency matrix generating unit
409 Phase control unit
501 Mixed signal information
502 Mixed signal decoding unit
503 Signal separating unit
504 Gain control unit
505 Output signal (1)
506 Output signal (2)
507 Supplementary information
508 Time-frequency matrix generating unit
509 Phase control unit
510 Linear prediction filter adapting unit
600 Conventional multi-channel AAC encoder
610 Conventional player
611 Multi-channel AAC decoding unit
612 Downmix unit
613 Speakers or headphones
700 Encoder
701 Downmix unit
702 Supplementary information generating unit
703 Encoding unit
710 Portable player
711 Mixed signal decoding unit
720 Headphones or speakers
730 Multi-channel home player
740 Speakers

DETAILED DESCRIPTION OF THE INVENTION

Embodiments of the present invention will be described below with reference to the drawings.

First Embodiment

Figure 2:
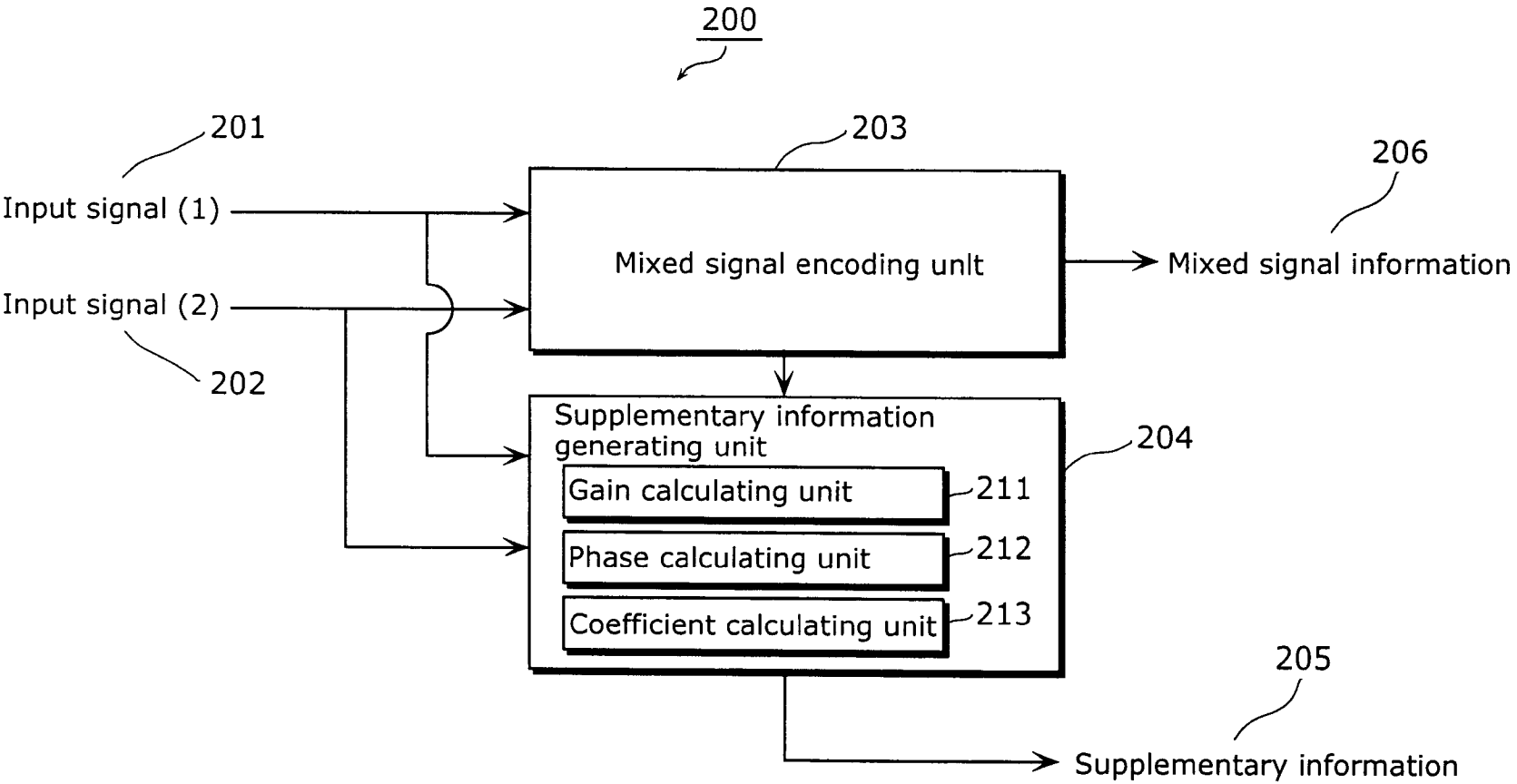
FIG. 2 is a schematic diagram of main parts of an audio signal encoder of the present invention.

FIG. 2 is a block diagram showing the structure of an audio signal encoder 200 which generates a coded stream decodable by an audio signal decoder of the present invention. This audio signal encoder 200 inputs at least 2 signals, generates, from the input signals, a mixed signal fewer than the input signals, and generates a coded stream including one coded data indicating the mixed signal and supplementary information represented using bits fewer than those of the coded data. The audio signal encoder 200 includes a mixed signal encoding unit 203 and a supplementary information generating unit 204. The supplementary information generating unit 204 includes locally a gain calculating unit 211, a phase calculating unit 212, and a coefficient calculating unit 213. To simplify the description, the case of using 2 input signals is described. The mixed signal encoding unit 203 and the supplementary information generating unit 204 receive both inputs of an input signal (1) 201 and an input signal (2) 202, and the mixed signal encoding unit 203 generates mixed signals and mixed signal information 206. Here, the mixed signals are obtained by superimposing the input signal (1) 201 and the input signal (2) 202 according to a predetermined method. The supplementary information generating unit 204 generates supplementary information 205 from the input signal (1) 201 and input signal (2) 202 and the mixed signal which is an output of the mixed signal encoding unit 203.

More specifically, the mixed signal encoding unit 203 generates a mixed signal by adding the input signal (1) 201 and input signal (2) 202 according to a constant predetermined method, codes the mixed signal, and outputs mixed signal information 206. Here, as a coding method of the mixed signal encoding unit 203, a method such as the AAC may be used, but methods are not limited.

The supplementary information generating unit 204 generates the supplementary information 205 by using the input signal (1) 201 and input signal (2) 202, the mixed signal generated by the mixed signal encoding unit 203, and the mixed signal information 206. Here, the supplementary information 205 is generated so as to be information enabling to separate the mixed signal into signals which are acoustically equal to the input signal (1) 201 and input signal (2) 202 which are pre-mixing signals as much as possible. Hence, the pre-mixing input signal (1) 201 and input signal (2) 202 may be separated from the mixed signal so as to be completely identical, and they may be separated so as to sound substantially identical. Even if they sound different, the supplementary information is included within the scope of the present invention, and the inclusion of such information for separating signals in this way is important. The supplementary information generating unit may code signals to be inputted according to, for example, a coding method using Quadrature Mirror Filter (QMF) bank, and may code the signals according to, a coding method using such as Fast Fourier Transform (FFT).

The gain calculating unit 211 compares the input signal (1) 201 and input signal (2) 202 with the mixed signal, and calculates gain for generating, from the mixed signal, signals equal to the input signal (1) 201 and input signal (2) 202. More specifically, the gain calculating unit 211 firstly performs QMF filter processing on the input signal (1) 201 and input signal (2) 202 and the mixed signal on a frame basis. Next, the gain calculating unit 211 transforms the input signal (1) 201 and input signal (2) 202 and the mixed signal into subband signals in a time-frequency domain. Subsequently, the gain calculating unit 211 divides the time-frequency domain in the temporal direction and the spatial direction, and within the respective divided regions, it compares these subband signals respectively transformed from the input signal (1) 201 and input signal (2) 202 with the subband signals transformed from the mixed signal. Next, it calculates gain for representing these subband signals transformed from the input signal (1) 201 and input signal (2) 202 by using the subband signals transformed from the mixed signal on a divided region basis. Further, it generates a time-frequency matrix showing a gain distribution calculated for each of the divided regions, and outputs the time-frequency matrix together with the information indicating the division method of the time-frequency domain as the supplementary information 205. Note that the gain distribution calculated here may be calculated for the subband signals transformed from one of the input signal (1) 201 and the input signal (2) 202. When one of the input signal (1) 201 and the input signal (2) 202 is generated from the mixed signal, the other input signal among the input signal (1) 201 and the input signal (2) 202 can be obtained by subtracting the input signal generated from the mixed signal.

In addition, for example, it is predicted that audio signals and so on gathered through an adjacent microphone and the like have a high correlation also in the spectra. In this case, a phase calculating unit 212 performs QMF filter processing on the respective input signal (1) 201 and input signal (2) 202 and the mixed signal on a frame basis as the gain calculating unit 211 does. Further, the phase calculating unit 212 calculates phase differences (delay amounts) between the subband signals obtained from the input signal (1) 201 and the subband signals obtained from the input signal (2) 202 on a subband basis, and outputs the calculated phase differences and the gain in these cases as the supplementary information. Note that these phase differences between the input signal (1) 201 and the input signal (2) 202 can be easily perceptible by hearing in the low frequency region, but in the high frequency region it is difficult to be acoustically perceptible. Therefore, in the case where these subband signals have a high frequency, the calculation of these phase differences may be omitted. In addition, in the case where the correlation between the input signal (1) 201 and the input signal (2) 202 is low, the phase calculating unit 212 does not include the calculated value even after the phase difference is calculated.

Further, in the case where the correlation between the input signal (1) 201 and the input signal (2) 202 is low, one of the input signal (1) 201 and the input signal (2) 202 is regarded as a signal (noise signal) having no correlation to the other signal. Accordingly, in the case where the correlation between the input signal (1) 201 and the input signal (2) 202 is low, the coefficient calculating unit 213 generates a flag showing that the correlation between the input signal (1) 201 and the input signal (2) 202 is low first. It is defined that a linear prediction filter (function) where a mixed signal is an input signal, and linear prediction coefficients (LPC) are derived so that an output by the filter approximates one of the pre-mixing signals as much as possible. When the mixed signal is composed of 2 signals, it may derive 2 sets of linear prediction coefficient streams and output both or one of the streams as the supplementary information. Even in the case where this mixed signal is composed of multiple input signals, it derives such linear coefficients that enable to generate an input signal which approximates at least one of these input signals as much as possible. With this structure, the coefficient calculating unit 213 calculates the linear prediction coefficients of this function, and outputs, as the supplementary information, the calculated linear prediction coefficients and a flag indicating that the correlation between the input signal (1) 201 and the input signal (2) 202 is low. Here, it is assumed that the flag shows that the correlation between the input signal (1) 201 and the input signal (2) 202 is low, however, comparing the whole signals is not the only case. Note that it may generate this flag for each subband signal obtained by using QMF filter processing.

Figure 3:
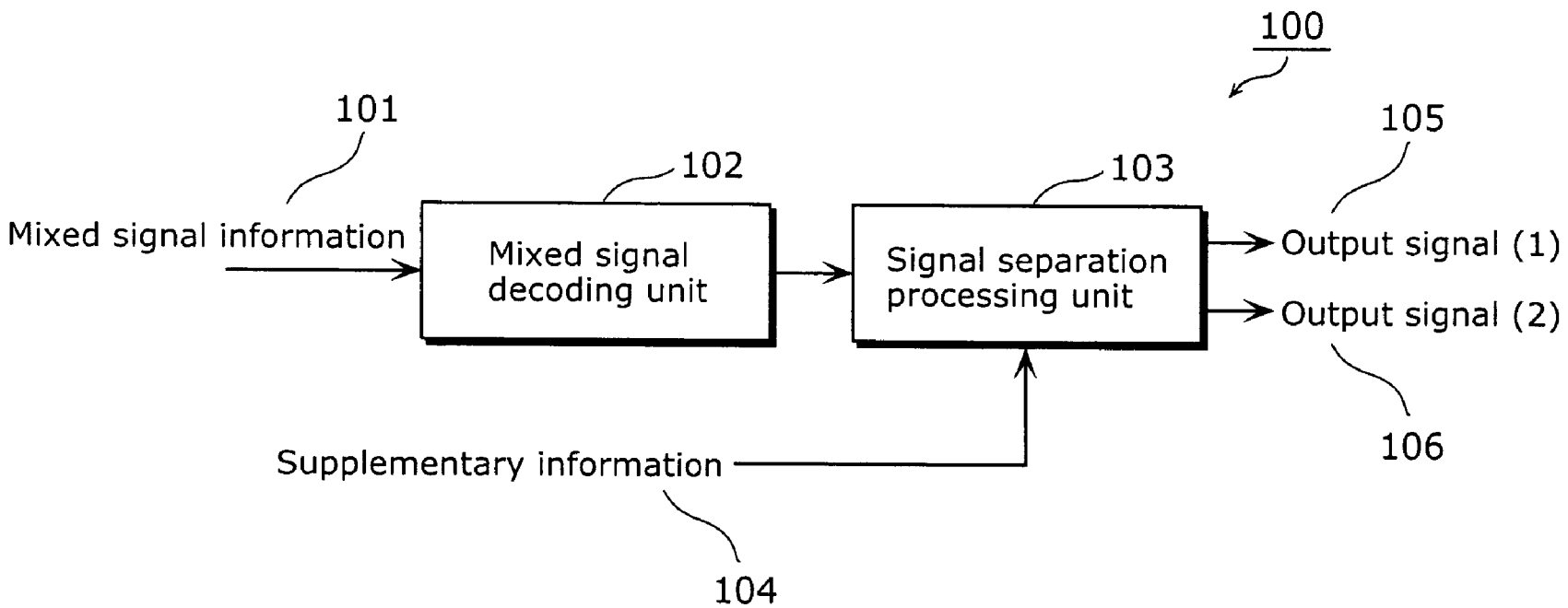
FIG. 3 is a schematic diagram of main parts of an audio signal decoder of the present invention.

Next, a decoding method is described with reference to FIG. 3. FIG. 3 is a schematic diagram of the main part structure of an audio signal decoder 100 of the present invention. The audio signal decoder 100 extracts, in advance, the mixed signal information and the supplementary information from a coded stream to be inputted, and separates the output signal (1) 105 and the output signal (2) 106 from the decoded mixed signal information. The audio signal decoder 100 includes a mixed signal decoding unit 102 and a signal separation processing unit 103.

Figure 4:
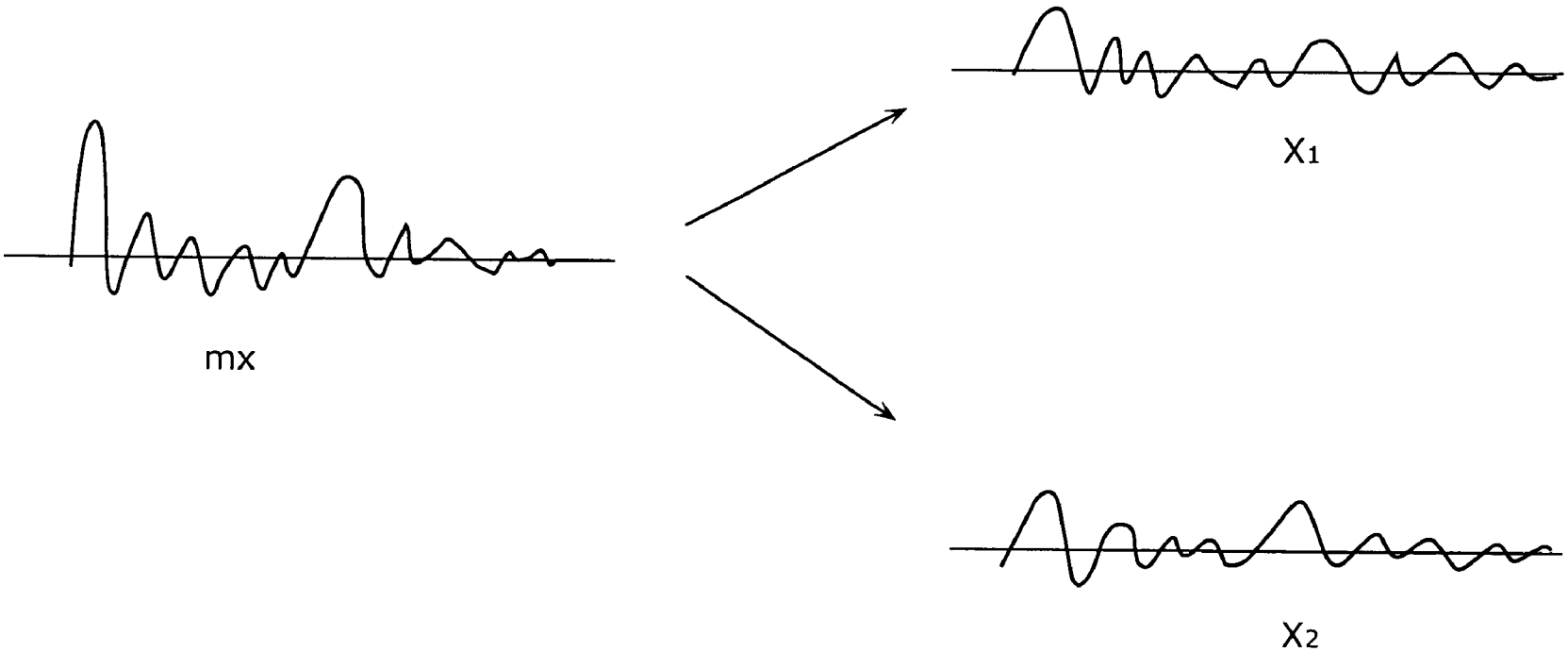
FIG. 4 is a diagram showing how a mixed signal mx which is a mixture of 2 signals is separated into a signal x1 and a signal x2 which are acoustically approximate to the original signals in an audio signal decoder of an embodiment.

Before the audio signal decoder 100, the mixed signal information 101 extracted from the coded stream is decoded from coded data format into audio signal format in the mixed signal decoding unit 102. The format of the audio signal is not limited to the signal format on the time axis. The format may be signal format on the frequency axis and may be represented by using both the time and frequency axes. The output signal from the mixed signal decoding unit 102 and the supplementary information 104 are inputted into the signal separation processing unit 103 and separated into signals, and these signals are synthesized and outputted as the output signal (1) 105 and output signal (2) 106. FIG. 4 is a diagram showing how 2 signals of x1 and x2 which are acoustically approximate to the original signals are separated from a mixed signal mx which is a mixture of the 2 signals in the audio signal decoder of this embodiment. The audio signal decoder 100 of the present invention separates the signal x1 and signal x2 which are acoustically approximate to the signal x1 and signal x2 which are the original signals from the mixed signal mx based on the supplementary information extracted from the coded stream.

Figure 5:
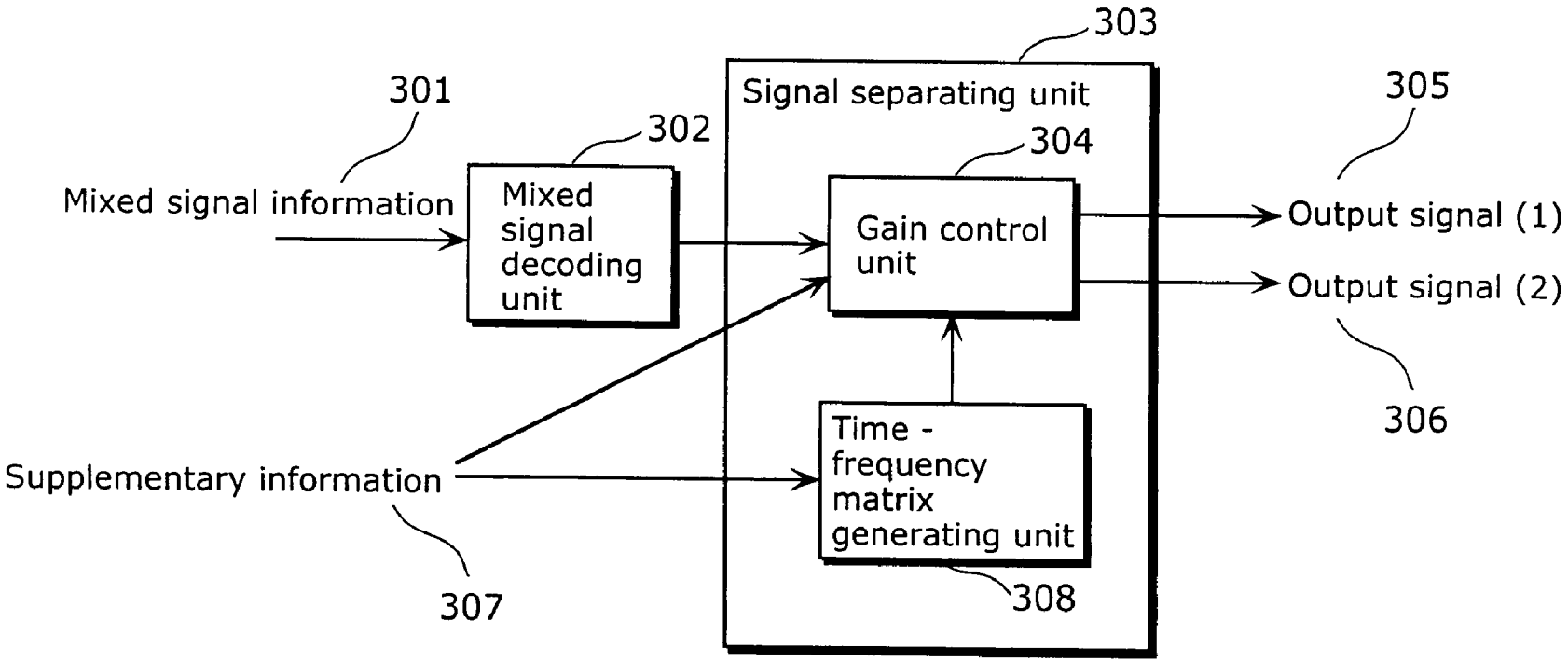
FIG. 5 is a diagram showing an example of the structure of the audio signal decoder of this embodiment more specifically.

The decoding method of the present invention is described below in detail with reference to FIG. 5. FIG. 5 is a diagram showing an example of the structure of the audio signal decoder 100 in this embodiment in the case where it performs gain control. The audio signal decoder 100 of this embodiment includes: a mixed signal decoding unit 302; a signal separating unit 303; a gain control unit 304; and a time-frequency matrix generating unit 308.

Before the audio signal decoder 100 shown in FIG. 5, the mixed signal information 301 extracted from the coded stream in advance is inputted to the mixed signal decoding unit 302. The mixed signal information 301 is decoded from the coded data format into the audio signal format in the mixed signal decoding unit 302. The format of the audio signal is not limited to the signal format on the time axis. The format may be a signal format on the frequency axis and may be represented by using both the time and frequency axes. The output signals of the mixed signal decoding unit 302 and the supplementary information 307 are inputted to the signal separating unit 303. The signal separating unit 303 separates the mixed audio signal decoded based on the supplementary information 307 into multiple signals. More specifically, according to the information indicating a division method of the time-frequency domain (or frequency domain) included in the supplementary information 307, the domain to which the mixed audio signal belong is divided. Here, to simplify the description, the case of using 2 input signals is described, however, the number of signals is not limited to 2. On the other hand, the time-frequency matrix generating unit 308 generates, based on the supplementary information 307, gain for the formats of the audio signals equal to the outputs from the mixed signal decoding unit 302 or the multiple output signals from the signal separating unit 303. For example, in the case where the signals are the simple signal formats on the time region, the gain information about at least one piece of time in the time region is outputted from the time-frequency matrix generating unit 308. In the case where the audio formats are represented on both the time and frequency axes composed of multiple subbands such as a QMF filter, the 2-dimensional gain information about time and frequency dimensions is outputted from the time-frequency matrix generating unit 308. To the gain information like this and the multiple audio signals from the signal separating unit 303, the gain control unit 304 applies gain control compliant with the data formats and outputs the output signal (1) 305 and output signal (2) 306.

The audio signal decoder structured like this can obtain multiple audio signals on which gain control has been performed appropriately from the mixed audio signal.

Figure 6A:
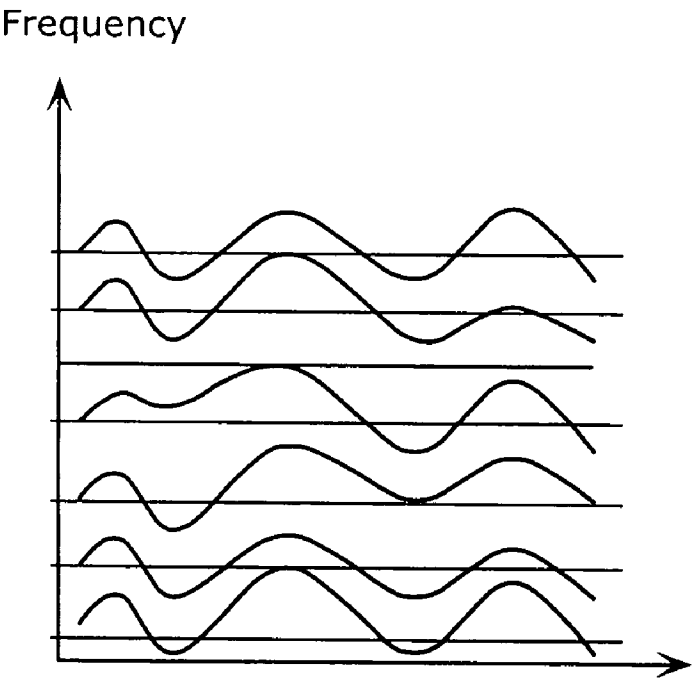
FIG. 6A is a diagram showing a subband signal which is an output from a mixed signal decoding unit shown in FIG. 5.
Figure 6B:
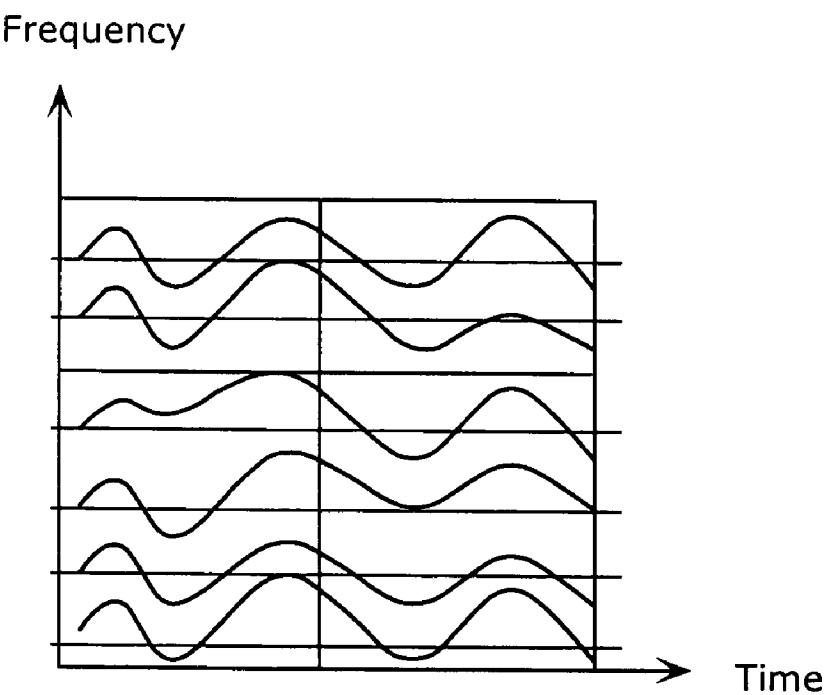
FIG. 6B shows an example where a division method of a time-frequency domain shown in FIG. 7 is applied to the subband signals shown in FIG. 6A.
Figure 7:
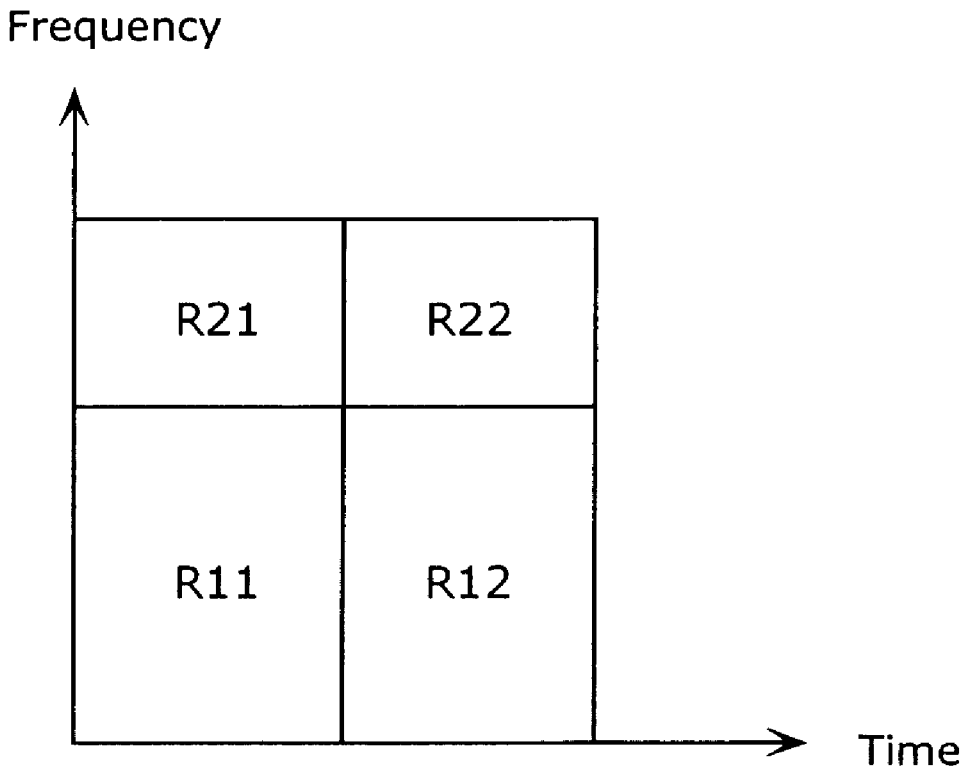
FIG. 7 is a diagram showing an example of a division method of a domain where an output signal from the mixed signal decoding unit is represented.

The gain control is described below in detail with reference to FIG. 6 and FIG. 7. FIGS. 6(*a*) and 6(*b*) each show a diagram of an example of gain control to each subband signal in the case where the output from the mixed signal decoding unit 302 shown in FIG. 5 is a QMF filter. FIG. 7 is a diagram showing an example of a division method of a domain on which the output signal from the mixed signal decoding unit 302 is represented. FIG. 6 (*a*) is a diagram showing the subband signals which are the outputs from the mixed signal decoding unit 302 shown in FIG. 5. In this way, the subband signals outputted from the QMF filter are represented as signals in the 2-dimensional domain formed by the time axis and the frequency axis.

Accordingly, in the case where the audio formats are composed by using the QMF filter, gain control by using the time-frequency matrix is easily performed when the audio signals are handled on a frame basis.

For example, it is assumed that a QMF filter composed of 32 subbands is structured. Handling 1024 samples of audio signals per 1 frame results in making it possible to obtain, as an audio format, a time-frequency matrix including 32 samples in the time direction and 32 bands in the frequency direction (subbands). In the case of performing gain control of these 1024 samples of signals, as shown in FIG. 7, the gain control can be easily performed by dividing the region in the frequency direction and the time direction, and by defining gain control coefficients (R11, R12, R21 and R22) for the respectively divided regions. Here, a matrix made up of the 4 elements from R11 to R22 is used for convenience, but the number of coefficients in the time direction and the frequency direction is not limited to this. FIG. 6 shows application examples of gain control. In other words, FIG. 6(*b*) shows an example where the division method of the time-frequency domain shown in FIG. 7 is applied to the subband signals shown in FIG. 6(*a*). FIG. 6(*b*) shows the case where the QMF filter is 6-subband output, and when it is divided into 2; that is, the 4 bands in the low frequency region and the 2-bands in the high frequency region, and is divided into 2 evenly in the time direction. In this example, signals are obtained by multiplying the signal streams obtained from the QMF filter which is present in these 4 regions by these gain R11, R12, R21 and R22, and the obtained signals are outputted.

There is no particular limitation on the signal streams to be mixed. Cases conceivable in the case of handling multi-channel audio signal streams are: the case where back-channel signals are mixed into front-channel signals; and the case where center-channel signals are further mixed into the front-channel signals. Thus, the so-called downmix signals are available as the mixed signals.

Figure 8:
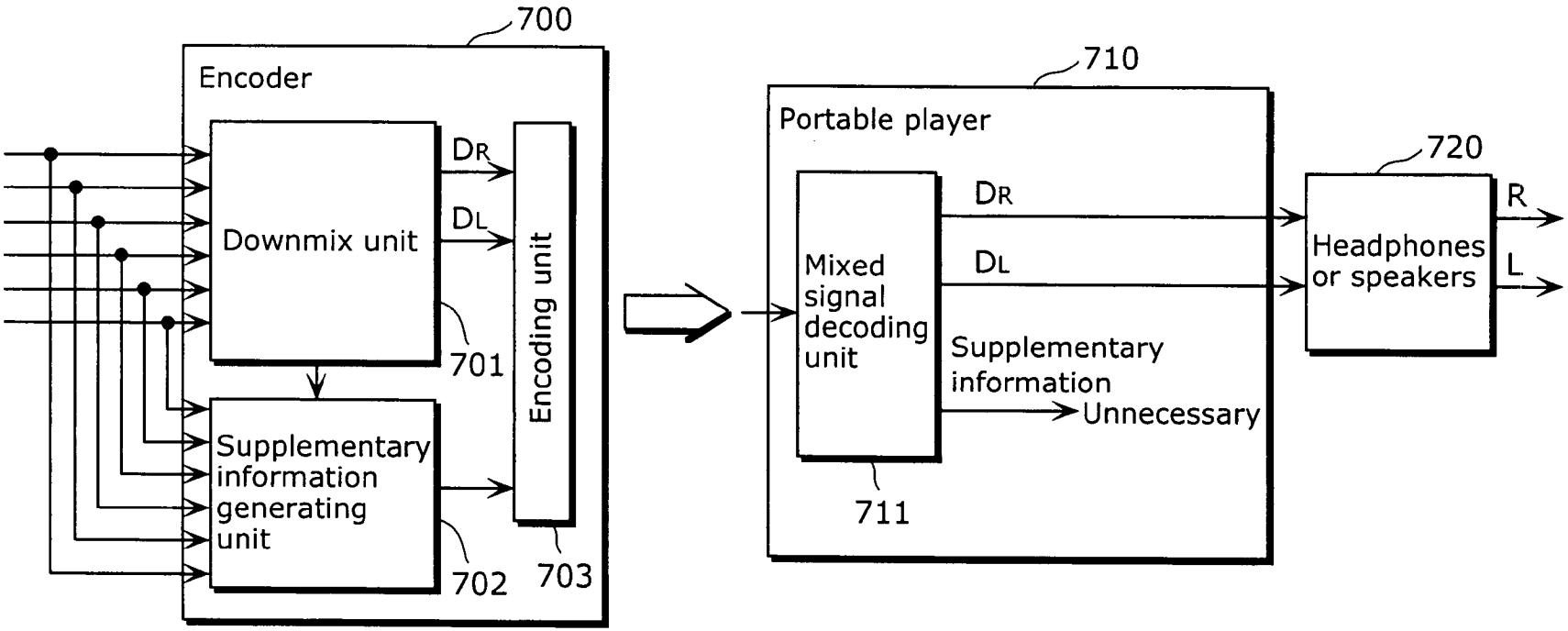
FIG. 8 is a diagram showing an example of the structure of an audio signal system in the case where a coded stream from an encoder is reproduced by a 2-channel portable player.

FIG. 8 is a diagram showing an example of the structure of an audio signal system in the case where coded streams from an encoder 700 are reproduced by a 2-channel portable player. As shown in the figure, this audio signal system includes: an encoder 700; a portable player 710 and headphones or speakers 720. The encoder 700 receives inputs of, for example, 5.1 multi-channel audio signal streams, and outputs 2-channel coded audio streams downmixed from the 5.1 channels. The encoder 700 includes: a downmix unit 701; a supplementary information generating unit 702; and an encoding unit 703. The downmix unit 701 generates 2-channel downmix signals from the 5.1 multi-channel audio signal streams, and outputs the generated downmix signals DL and DR to the encoding unit 703. The supplementary information generating unit 702 generates the information for decoding the 5.1 multi-channel signals from the generated downmix signals DL and DR, and outputs the information as the supplementary information to the encoding unit 703. The encoding unit 703 codes and multiplexes the generated downmix signals DL and DR and the supplementary information, and outputs them as coded streams. The portable player 710 in this audio signal system is connected to 2-channel headphones or speakers 720, and only the 2-channel stereo reproduction is possible. The portable player 710 includes a mixed signal decoding unit 711, and can perform reproduction through the 2-channel headphones or speakers 720 by only causing the mixed signal decoding unit 711 to decode the coded streams obtained from the encoder 700.

Figure 9:
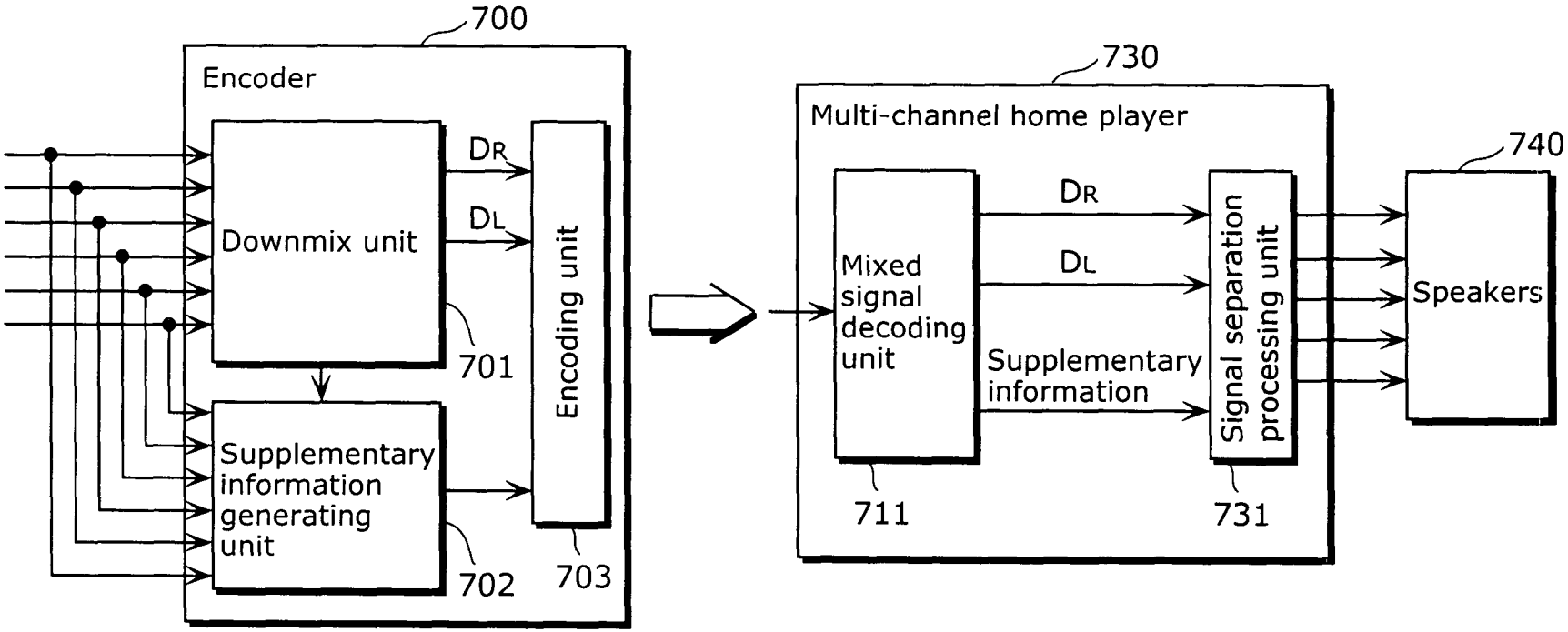
FIG. 9 is a diagram showing an example of the structure of an audio signal system in the case where a coded stream from an encoder is reproduced by a home player which is capable of reproducing multi-channel audio signals.

FIG. 9 is a diagram showing an example of the structure of the audio signal system in the case where coded streams from an encoder 700 is reproduced by a home player which is capable of reproducing multi-channel audio signals. As shown in the figure, this audio signal system includes: an encoder 700; a multi-channel home player 730; and speakers 740. The internal structure of the encoder 700 is the same as that of the encoder 700 shown in FIG. 8, and thus a description of these is omitted. The multi-channel home player 730 includes: a mixed signal decoding unit 711; and a signal separation processing unit 731, and is connected to the speakers 740 which is capable of reproducing the 5.1 multi-channel signals. In this multi-channel home player 730, the mixed signal decoding unit 711 decodes the coded stream obtained from the encoder 700, and extracts supplementary information and the downmix signals DL and DR. The signal separation processing unit 731 generates 5.1 multi-channel signals from the extracted downmix signals DL and DR based on the extracted supplementary information.

As examples shown in FIG. 8 and FIG. 9, even in the case where the same coded streams are inputted, the portable player which reproduces only 2-channel signals can reproduce desirable downmix audio signals by simply decoding the mixed signals in the coded streams. This provides an effect of reducing power consumption, thus battery can be used longer. Additionally, since a home player which is capable of reproducing multi-channel audio signals and is placed in a home is not driven by battery, this makes it possible to enjoy high quality reproduction of audio signals without minding power consumption.

Second Embodiment

A decoder of this embodiment is described below in detail with reference to FIG. 10.

Figure 10:
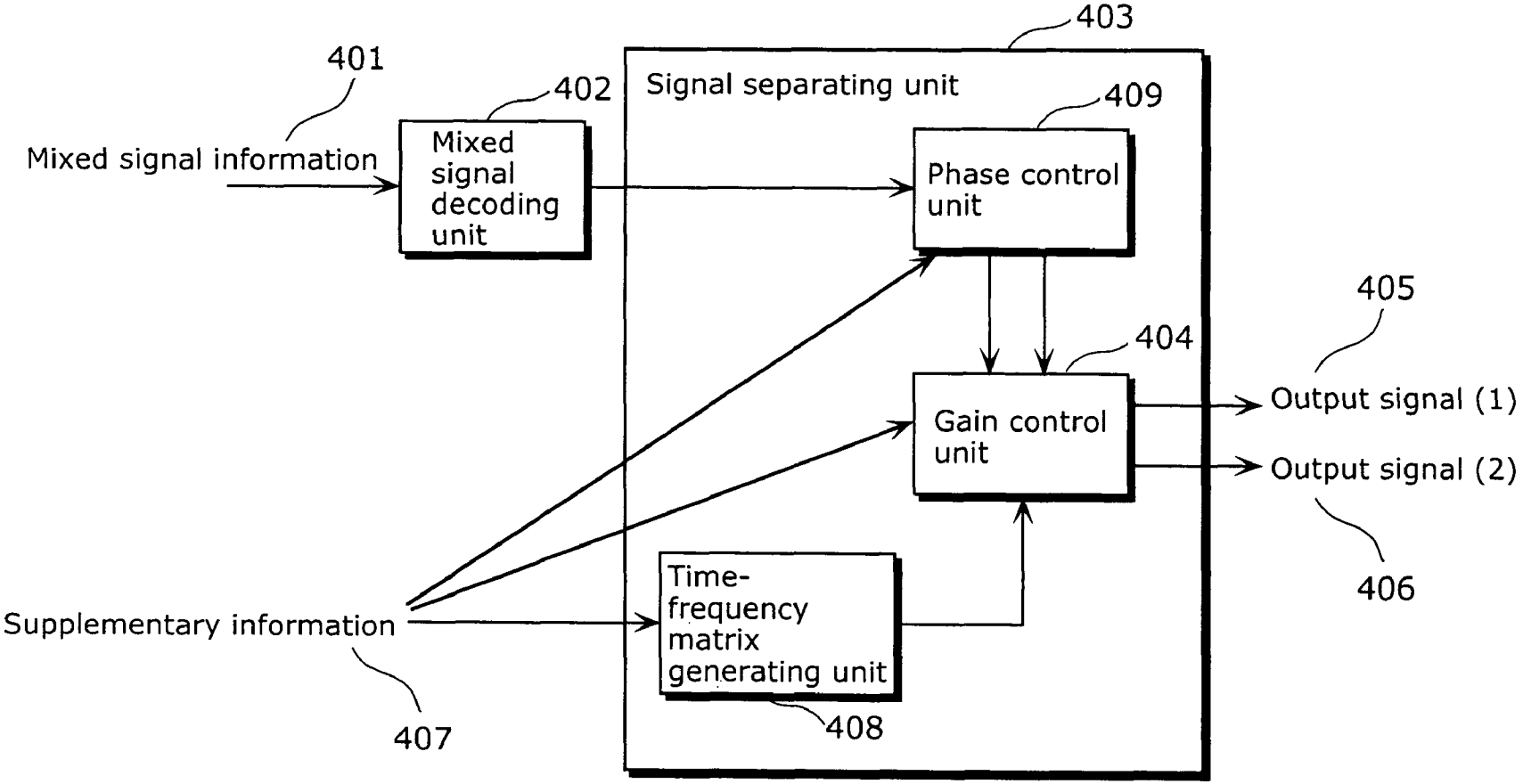
FIG. 10 is a diagram showing an example of the structure of the audio signal decoder of this embodiment in the case where phase control is further performed.

FIG. 10 is a diagram showing an example of the structure in the case where the audio signal decoder of this embodiment also performs phase control. The audio signal decoder of the second embodiment inputs the mixed signal information 401 that is a coded stream and the supplementary information 407, and outputs the output signal (1) 405 and output signal (2) 406 based on the inputted mixed signal information 401 and supplementary information 407. The audio signal decoder includes: a mixed signal decoding unit 402; a signal separating unit 403; a gain control unit 404; a time-frequency matrix generating unit 408; and a phase control unit 409.

The second embodiment is different in structure from the first embodiment only in that it includes a phase control unit 409, and other than that, it is the same as the first embodiment. Thus, only the structure of the phase control unit 409 is described in detail in this second embodiment.

In the case where signals mixed in coding have a correlation, and in particular, in the case where one of these signals is delayed from the other signal and is handled as having different gain, the mixed signal is represented as Formula 1.

$$mx = x1 + x2 \qquad \text{[Formula 1]}$$
$$= x1 + A * x1 * phaseFactor$$

Here, mx is the mixed signal, x1 and x2 are input signals (pre-mixing signals), A is a gain correction, and phaseFactor is a coefficient multiplied depending on a phase difference. Accordingly, since the mixed signal mx is represented as a function of the signal x1, the phase control unit 409 can easily calculate the signal x1 from the mixed signal mx and separate it. Further, on the signals x1 and x2 separated in this way, the gain control unit 404 performs gain control according to the time-frequency matrix obtained from the supplementary information 407. Therefore, it can output the output signal (1) 405 and output signal (2) 406 which are closer to the original sounds.

A and phaseFactor are not derived from the mixed signal and can be derived from the signals at the time of coding (that is, multiple mixing signals). Therefore, when these signals are coded into the supplementary information 407 in the encoder, the phase control unit 409 can perform phase control of the respectively separated signals.

The phase difference may be coded as a sample number which is not limited to an integer, and may be given as a covariance matrix. The covariance matrix is a technique generally known by the person skilled in the art, and thus a description of this is omitted.

There is a frequency region for which phase information is important in a perception of hearing, and there are signals and a frequency region for which phase information does not give a big influence on the sound quality. Therefore, there is no need to send phase information for all frequency bands and all time regions. In other words, in a frequency band for which phase information is not important in a perception of hearing, and a frequency band for which phase information does not give a big influence on the sound quality, phase control of subband signals can be omitted. Accordingly, generating phase information for each subband signal eliminates the necessity of sending additional information, which makes it possible to reduce the data amount of supplementary information.

Third Embodiment

Figure 11:
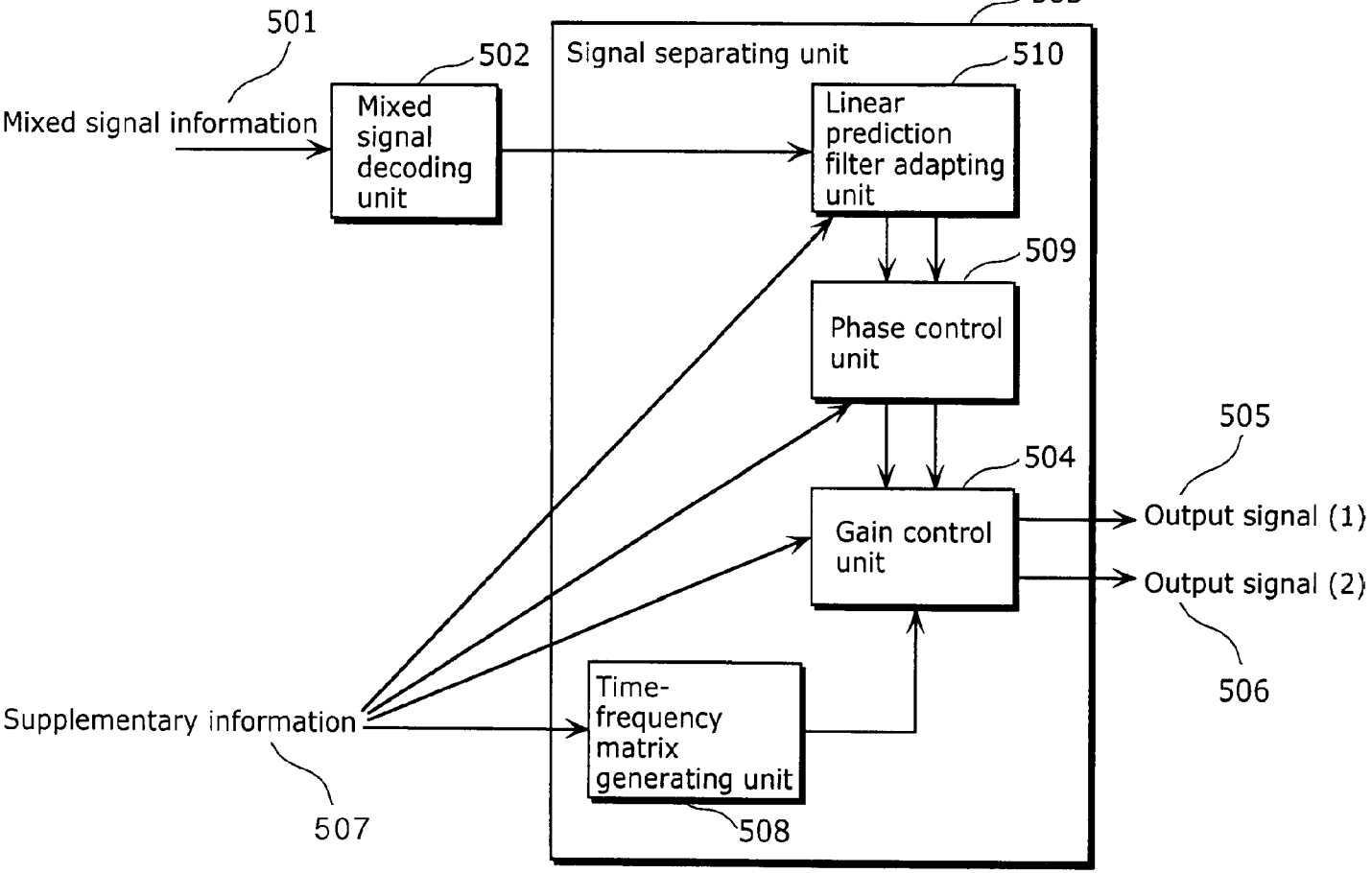
FIG. 11 is a diagram showing an example of the structure of the audio signal decoder of this embodiment when using a linear prediction filter in the case where a correlation between input signals is small.

A decoder of the present invention is described in detail with reference to FIG. 11. FIG. 11 is a diagram showing an example of the structure of the audio signal decoder of this embodiment when using a linear prediction filter in the case where a correlation between input signals is small.

The audio signal decoder of the third embodiment receives inputs of the mixed signal information 501 and supplementary information 507. In the case where the original input signals have no high correlation, the audio signal decoder generates one of the signals regarding as no-correlation signal (noise signal) represented as a function of the mixed signal, and outputs the output signal (1) 505 and output signal (2) 506. The audio signal decoder includes: a mixed signal decoding unit 502; a signal separating unit 503; a gain control unit 504; a time-frequency matrix generating unit 508; a phase control unit 509; and a linear prediction filter adapting unit 510.

First, the decoder of this third embodiment is for illustrating the decoder in the first embodiment in detail.

The third embodiment is different in structure from the second embodiment only in that it includes a linear prediction filter adapting unit 510, and other than that, it is the same as the second embodiment. Thus, only the structure of the linear prediction filter adapting unit 510 is described in detail in this third embodiment.

In the case where signals mixed in coding have a low correlation, for one of the signals, it is impossible to simply represent the other signal by using a delay. In this case, it is conceivable that the linear prediction filter adapting unit 510 performs coding regarding the other signal as no-correlation signal (noise signal). In this case, coding a flag indicating a low correlation in a coded stream in advance makes it possible to execute separation processing in decoding in the case where the correlation is low. This information may be coded on a frequency band basis or at a time interval. In addition, this flag may be coded in a coded stream on a subband signal basis.

$$mx = x1 + x2 \qquad \text{[Formula 2]}$$
$$= x1 + Func(x1 + x2)$$

Here, mx is the mixed signal, x1 and x2 are input signals (mixing signals), and Func( ) is a multinomial made of linear prediction coefficients.

The signals mx, x1 and x2 are not derived from the mixed signal, and can be used in coding (as multiple pre-mixing signals). Therefore, on condition that the coefficients of the multinomial made of Func( ) are derived from the signals mx, x1 and x2 and these coefficients are coded into supplementary information 507 in advance, the linear prediction filter adapting unit 510 can derive the x1 and x2.

$$x2 = \text{Func}(x1 + x2) \qquad \text{[Formula 3]}$$

Thus, it is only that the coefficients of Func( ) like Formula 3 are derived and coded.

Those cases described above are: a case where the correlation of inputs signals is not so high; and a case where there are 2 or more input signals, and when one of these signals is a reference signal, the correlations between the reference signal and the respective other input signals are not so high. In these cases, including presence or absence of a correlation between these input signals as a flag in a coded stream makes it possible to represent the other signals as no-correlation signals (noise signals) represented by a function of the mixed signal. In addition, in the case where the correlation between the input signals is high, the other signal can be represented as a delay signal of the reference signal. Subsequently, multiplying the respective signals separated from the mixed signal in this way by gain indicated as a time-frequency matrix makes it possible to obtain output signals which are more faithfull to the inputted original signals.

INDUSTRIAL APPLICABILITY

An audio signal decoder and encoder of the present invention are applicable for various applications to which a conventional audio coding method and decoding method have been applied.

Coded streams which are audio-coded bit streams are now used in the case of transmitting broadcasting contents, as an application of recording them in a storage medium such as a DVD and an SD card and reproducing them, and in the case of transmitting the AV contents to a communication apparatus represented as a mobile phone. In addition, they are useful as electronic data exchanged on the Internet in the case of transmitting audio signals.

The audio signal decoder of the present invention is useful as an audio signal reproducing apparatus of portable type such as a mobile phone driven by battery. In addition, the audio signal decoder of the present invention is useful as a multi-channel home player which is capable of performing reproduction by exchanging multi-channel reproduction and 2-channel reproduction. In addition, the audio signal encoder of the present invention is useful as an audio signal encoder placed at a broadcasting station and a content distribution server which distribute audio contents to an audio signal reproducing apparatus of portable type such as a is mobile phone through a transmission path with a narrow bandwidth.

The invention claimed is:

1. An audio signal decoder which decodes a first coded stream and outputs audio signals, comprising:

a processor;

an extraction unit configured to extract, from the first coded stream, a second coded stream representing at least one mixed signal having less than a plurality of pre-mixing audio signals mixed into the mixed signal, and to extract, from the first coded stream, supplementary information for reverting the mixed signal to the pre-mixing audio signals, said extraction unit using said processor to extract the second coded stream and the supplementary information;

a decoding unit configured to decode the second coded stream representing the mixed signal;

a signal separating unit configured to separate the mixed signal generated by said decoding unit based on the extracted supplementary information, and to generate a plurality of audio signals which are acoustically approximate to the plurality of pre-mixing audio signals; and a reproducing unit configured to reproduce the decoded mixed signal or the plurality of audio signals generated by said signal separating unit, wherein the supplementary information includes linear prediction coefficients for representing at least one of the plurality of pre-mixing audio signals as a function of the mixed signal, wherein said signal separating unit includes a no-correlation signal calculating unit configured to calculate a no-correlation signal representing, as a function of the mixed signal, a reference signal that is one of the plurality of pre-mixing audio signals by using the linear prediction coefficients in the supplementary information, wherein the supplementary information includes a flag indicating a degree of correlation between the plurality of pre-mixing audio signals, and wherein, in a case where the flag included in the supplementary information indicates that the plurality of pre-mixing audio signals have a low correlation, said signal separating unit is configured to generate the plurality of pre-mixing audio signals other than the reference signal by removing the no-correlation signal from the mixed signal.

2. The audio signal decoder according to claim 1, wherein the linear prediction coefficients define a linear prediction filter passing the mixed signal as an input signal by using a function, and the linear prediction coefficients are derived so that an output of the linear prediction filter represents the at least one the plurality of pre-mixing audio signals mixed into the mixed signal.

3. The audio signal decoder according to claim 1, wherein the plurality of pre-mixing audio signals are audio signals including multi-channel signals, and the mixed signal is a downmix signal generated by downmixing the multi-channel signals, said decoding unit is configured to generate the downmix signal by decoding the second coded stream representing the mixed signal, and said signal separating unit is configured to generate the plurality of audio signals which are acoustically approximate to the multi-channel signals before being downmixed.

4. An audio signal encoder which encodes a mixed signal into which a plurality of pre-mixing audio signals have been mixed, said encoder comprising:

a processor;

a mixed signal generating unit configured to generate, using said processor, the mixed signal representing at least one audio signal having less than the plurality of pre-mixing audio signals by mixing the plurality of pre-mixing audio signals;

a supplementary information generating unit configured to generate supplementary information including linear prediction coefficients for calculating, from at least one of the plurality of pre-mixing audio signals, a no-correlation signal representing, as a function of the mixed signal, a reference signal that is one of the plurality of pre-mixing audio signals, and (ii) a flag indicating a degree of correlation between the plurality of pre-mixing audio signals, wherein, in a case where the flag indicates that the plurality of pre-mixing audio signals have a low correlation, the supplementary information indicates that a plurality of audio signals, which are acoustically approximate to the plurality of pre-mixing audio signals other than the reference signal, are generated from the mixed signal by removing the calculated no-correlation signal from the mixed signal;

a coding unit configured to code the mixed signal; and a coded stream generating unit configured to generate a first coded stream including the coded mixed signal and the generated supplementary information.

5. The audio signal encoder according to claim 4, wherein the linear prediction coefficients define a linear prediction filter passing the mixed signal as an input signal by using a function, and the linear prediction coefficients are derived so that an output of the linear prediction filter represents the at least one of the plurality of pre-mixing audio signals mixed into the mixed signal.

6. An audio signal decoding method for decoding a first coded stream and outputting audio signals, comprising:

extracting, using a processor, a second coded stream, from the first coded stream, representing at least one mixed signal having less than a plurality of pre-mixing audio signals mixed into the mixed signal;

extracting, from the first coded stream, supplementary information for reverting the mixed signal back to the plurality of pre-mixing audio signals, the supplementary information including (i) linear prediction coefficients for representing at least one of the plurality of pre-mixing audio signals as a function of the mixed signal, and (ii) a flag indicating a degree of correlation between the plurality of pre-mixing audio signals;

decoding the second coded stream representing the mixed signal;

calculating a no-correlation signal representing, as a function of the mixed signal, a reference signal that is one of the plurality of pre-mixing audio signals by using the linear prediction coefficients in the supplementary information in a case where the flag included in the supplementary information indicates that the plurality of pre-mixing audio signals have a low correlation, separating the mixed signal generated by said decoding by removing the no-correlation signal from the mixed signal, and generating a plurality of audio signals which are acoustically approximate to the plurality of pre-mixing audio signals other than the reference signal; and reproducing the decoded mixed signal or the plurality of audio signals separated from the mixed signal.

7. A non-transitory computer-readable recording medium having stored thereon a program for use in an audio signal decoder which decodes a first coded stream and outputs audio signals, wherein when executed, said program causes a computer to perform a method comprising:

extracting, from the first coded stream, a second coded stream representing at least one mixed signal having less than a plurality of pre-mixing audio signals mixed into the mixed signal;

extracting, from the inputted first coded stream, supplementary information for reverting the mixed signal back to the plurality of pre-mixing audio signals, the supplementary information including (i) linear prediction coefficients for representing at least one of the plurality of pre-mixing audio signals as a function of the mixed signal, and (ii) a flag indicating a degree of correlation between the plurality of pre-mixing audio signals;

decoding the second coded stream representing the mixed signal;

calculating a no-correlation signal representing, as a function of the mixed signal, a reference signal that is one of the plurality of pre-mixing signals by using the linear prediction coefficients in the supplementary information in a case where the flag included in the supplementary information indicates that the plurality of pre-mixing audio signals have a low correlation, separating the mixed signal generated by said decoding by removing the no-correlation signal from the mixed signal, and generating a plurality of audio signals which are acoustically approximate to the plurality of pre-mixing audio signals other than the reference signal; and reproducing the decoded mixed signal or the plurality of audio signals separated from the mixed signal.

* * * * *